US005080974A

United States Patent [19]

Makino

[11] Patent Number: 5,080,974

[45] Date of Patent: Jan. 14, 1992

[54] SURFACE-MODIFIED WHOLLY AROMATIC POLYAMIDE FILAMENTS

[75] Inventor: Shoji Makino, Ibaraki, Japan

[73] Assignee: Teijin Limited, Osaka, Japan

[21] Appl. No.: 394,648

[22] Filed: Aug. 16, 1989

[30] Foreign Application Priority Data

Aug. 30, 1988 [JP] Japan ..... 63-213546

[51] Int. Cl.[5] ..... D02G 3/00

[52] U.S. Cl. ..... 428/378; 428/373; 428/375; 428/395; 252/8.6; 252/8.9

[58] Field of Search ..... 428/375, 378, 395, 373; 525/454; 252/8.9, 8.6, 8.75

[56] References Cited

U.S. PATENT DOCUMENTS

| | | | |
|---|---|---|---|
| 4,034,138 | 7/1977 | Babayan | 428/378 |
| 4,259,404 | 3/1981 | van Gils | 428/476.3 |
| 4,482,660 | 11/1984 | Minamisawa | 525/113 |
| 4,652,488 | 3/1987 | Willemsen | 428/395 |
| 4,891,267 | 1/1990 | Takahashi | 428/375 |

FOREIGN PATENT DOCUMENTS

| | | | |
|---|---|---|---|
| 0084453 | 7/1983 | European Pat. Off. . | |
| 0107887 | 5/1984 | European Pat. Off. . | |
| 0213681 | 3/1987 | European Pat. Off. . | |
| 940418 | 10/1963 | United Kingdom | 525/454 |

OTHER PUBLICATIONS

Database WPIL-Derwent 83-62338k, 82-96628e.

*Primary Examiner*—George F. Lesmes
*Assistant Examiner*—J. M. Gray
*Attorney, Agent, or Firm*—Burgess, Ryan & Wayne

[57] ABSTRACT

Surface-modified wholly aromatic polyamide filaments usable as a reinforcing material for rubber or synthetic resin articles, each comprising a wholly aromatic polyamide core filament; an intermediate coating layer formed on the core filament and comprising a copolymer of (a) a water-soluble or self-emulsifying urethane-modified bisphenol A type epoxy compound with an epoxy equivalent of 200 to 800 with (b) an aliphatic polyglycidylether compound with an epoxy equivalent of 100 to 250; and a surface coating layer formed on the intermediate coating layer and comprising a lubricant, the weight ratio of the intermediate coating layer to the surface coating layer being 20:80 to 80:20.

10 Claims, No Drawings

SURFACE-MODIFIED WHOLLY AROMATIC POLYAMIDE FILAMENTS

BACKGROUND OF THE INVENTION

1. Field of the Invention

The present invention relates to surface-modified wholly aromatic polyamide filaments. Particularly, the present invention relates to surface-modified wholly aromatic polyamide filaments having a satisfactory bundling property and reeling property and thus useful for reinforcing synthetic resin articles.

2. Description of the Related Art

It is known that there is a strong demand for high quality synthetic filaments having a superior mechanical strength, modules of elasticity, and thermal resistance.

Also, it is known that various attempts have been made to provide filament-reinforced synthetic resin articles in which reinforcing filaments having a high modulus of elasticity are embedded in a synthetic resin matrix to enhance the mechanical quality of the substrate. Especially, it is well known that wholly aromatic polyamide filaments have a high mechanical strength, modulus of elasticity, and thermal resistance and thus are useful as a reinforcing material for various shaped synthetic resin articles.

Further, it is known that wholly aromatic polyamide filaments have a low elongation and a high dimensional stability and thus are useful as reinforcing material for rubber articles, for example, timing belts, which need a high dimensional stability.

Nevertheless, wholly aromatic polyamide filaments having a high modulus of elasticity are disadvantageous in that the filaments have a high rigidity and thus a poor bundling property. Also, wholly aromatic polyamide filaments have a poor surface activity and thus an unsatisfactory bonding (adhesive) property.

In particular cases, when a wholly aromatic polyamide filament cord is contained in a raw edge type belt in which a cut face of the filament cord appears in a cut face of the belt, the individual filaments located in the cut face of the belt are easily frayed and separated from each other.

To eliminate the above-mentioned disadvantages, Japanese Unexamined Patent Publication (Kokai) No. 59-94640 and Japanese Examined Patent Publication (Kokoku) No. 53-37473 disclose a treatment of a multi filament yarn or other filament articles with a treating agent comprising an epoxy or isocyanate compound before or after the yarn or article is formed from the filaments. The treated multifilament yarn or other filament article exhibits a high resistance to separation of individual filaments from each other, and a high bonding (adhesive) property. Nevertheless, the treated multifilament yarn or other filament article has disadvantages, for example, an excessively high rigidity or stiffness and a low resistance to flexural fatigue. Therefore, the amount of the treating agent that can be applied to the surface of each filament is limited to a very low level.

Also, in the treated multifilament yarn, the coating layer comprising the treating agent must be completely cured before the yarn is wound up into a package.

If the curing is not effected or completed, the treating agent in the coating layer is naturally cured with time and causes the wound multifilament yarns to adhere to each other, which makes them difficult to unwind from the package, and thus some individual filaments in the yarn are broken and form a number of fluffs.

This phenomenon can be avoided by completely curing the coating layer before the winding procedure, but a complete curing procedure takes a long time, and thus the whole process time becomes undesirably long or the process speed becomes undesirably low. Therefore, an industrial utilization of conventional epoxy or isocyanate compounds is very difficult due to the low efficiency thereof.

Japanese Examined Patent Publication (Kokoku) No. 63-20454 discloses a process for immersion-treating an aromatic polyamide filament yarn with a urethane-modified epoxy resin in the form of a solution in an organic solvent or of an aqueous emulsion, but was found that the resultant coating layer exhibited a poor mechanical strength and an unsatisfactory bonding property. Also the solution of the modified epoxy resin in the organic solvent causes inconvenience during handling. Furthermore, when the aqueous emulsion of the modified epoxy resin is prepared by using an emulsifying agent comprising a surfactant, the emulsifying agent causes the resultant aqueous emulsion to exhibit a lowered bonding property.

Accordingly, there is a strong demand for new wholly aromatic polyamide filaments free from the above-mentioned disadvantages.

SUMMARY OF THE INVENTION

An object of the present invention is to provide surface-modified wholly aromatic polyamide filaments having a satisfactory bundling property and reeling property, and thus capable of being easily taken up from a yarn package.

Another object of the present invention is to provide surface-modified wholly aromatic polyamide filaments having an enhanced bonding property to rubber or synthetic resin materials, and thus useful as reinforcing material for rubber or synthetic resin articles.

The above-mentioned objects can be attained by the surface-modified wholly aromatic polyamide filaments of the present invention, each of which comprises a core filament consisting essentially of a wholly aromatic polyamide;

an intermediate coating layer formed on the peripheral surface of the core filament and comprising a copolymer of (a) at least one type of bisphenol A-type, urethane-modified epoxy compound having an epoxy equivalent of 200 to 800 and exhibiting a water-soluble property or a self-emulsifying property in water with (b) at least one type of aliphatic polyglycidylether compound having an epoxy equivalent of 100 to 250 and provided with two or more glycidylether groups per molecule thereof; and a surface coating layer formed on the intermediate coating layer and comprising, as a principal component, a lubricant, the ratio in weight of the intermediate coating layer to the surface coating layer being in the range of from 20:80 to 80:20.

DESCRIPTION OF THE PREFERRED EMBODIMENTS

The wholly aromatic polyimide filaments usable as a core filament for the present invention consist essentially of a wholly aromatic polyamide resin which is preferably a polymerization product of an aromatic dicarboxylic acid component comprising at least one member selected from, for example, the group consisting of terephthalic acid, isophthalic acid, 1,4-naphthalene dicarboxylic acid, 4,4'-byphenyldicarboxylic acid and anhydrides, acid chlorides, esters, and salts of the above-mentioned acids, with an aromatic diamine component comprising at least one member selected from, for example, the group consisting of p-phenylene diamine, m-phenylene diamine, 3,4'-diaminodiphenylether, and 4,4'-diaminodiphenylether.

The core filament preferably has a thickness of 0.5 to 10 denier, more preferably 1.0 to 3.0 denier.

In the individual surface modified filament of the present invention, an intermediate coating layer is formed on the peripheral surface of the core filament. The intermediate coating layer comprises a copolymer of (a) at least one type of bisphenol A-type urethane-modified epoxy compound with (b) at least one type of aliphatic polyglycidylether compound.

The bisphenol A-type urethane-modified epoxy compound (a) usable for the present invention must be water soluble or have a self-emulsifying property in water and have an epoxy equivalent of 200 to 800. When the epoxy equivalent is less than 200 or more than 800, the resultant surface-modified filaments exhibit an unsatisfactory softness or bonding (adhering) property.

The bisphenol A-type urethane-modified epoxy compound (a) is preferably selected from modified bisphenol A-type epoxy compounds having at least one modifying group selected from the group consisting of polyether- or polyester-type radicals per molecule thereof, and attached thereto through a urethane bond.

The above-mentioned types of the bisphenol A-type urethane-modified epoxy compound (a) are available, for example under the trademark Denacast from Nagase Kasei Co.

When the intermediate coating layer is made from a bisphenol A-type urethane-modified epoxy compound (a) alone, the resultant coating layer exhibits a high flexibility and an unsatisfactory bonding (adhering) property, and thus should be copolymerized with the aliphatic polyglycidylether compound to enhance the bonding property.

The aliphatic polyglycidylether compound (b) has an epoxy equivalent of 100 to 250 and is provided with two or more glycidylether groups per molecule thereof. When the epoxy equivalent is less than 100, the resultant coating layer exhibits an excessively high rigidity or stiffness and an unsatisfactorily low softness. When the epoxy equivalent is more than 250, the resultant coating layer exhibits a poor bonding property, a high viscosity, and a poor handling property.

The aliphatic polyglycidylether compound (b) is preferably selected from the group consisting of diglycidylethers of glycol compounds, for example, polyethylene glycol, polypropylene glycol, neopentylglycol; and polyglycidylethers of polyols, for example, glycerol, polyglycerol, trimethylol-propane, and sorbitol.

Preferably, the compound (b) is polyfunctional, as a polyfunctional compound (b) causes the resultant intermediate coating layer to be cross-linked at a high cross-linking density, and thus causes the resultant surface-modified filaments to exhibit an enhanced bundling property. Further, preferably the aliphatic polyglycidylether compound (b) is soluble in water, as a water soluble compound (b) can be easily handled.

Preferably, in the intermediate coating layer, the ratio (a/b) in weight of the bisphenol A-type, urethane-modified epoxy compound (a) to the aliphatic polyglycidylether compound (b) is from 95:5 to 20:80, more preferably from 90:10 to 40:60.

When the ratio (a/b) is more than 95:5, the resultant surface-modified filaments exhibit an excessively high rigidity or stiffness and the resultant surface-modified filament yarn or cord exhibits a reduced retention of mechanical strength, whereas the individual filaments are firmly bonded to each other and thus the resultant yarn or cord exhibits a high resistance to fraying. Also, when the ratio (a/b) is more than 95:5, the resultant intermediate coating layer is gradually cured even after the surface-modified filament yarn or cord is wound up into a package, and thus unwinding of the yarn or cord becomes very difficult because the individual filaments adhere to each other.

When the ratio (a/b) is less than 20:80, the resultant surface-modified individual filaments exhibit an unsatisfactory bonding property, whereas the resultant surface-modified filament yarn or cord exhibits a high softness and a satisfactory retention of mechanical strength.

The copolymerization (curing) of the bisphenol A-type, urethane-modified epoxy compound (a) with the aliphatic polyglycidylether compound (b) is carried out preferably in the presence of a catalyst. The catalyst can be selected from conventional accelerators for hardening (curing) reaction of epoxy compound. Usually, the catalyst comprise at least one amine compound, especially high reactive heterocyclic amine, for example, piperadine hydrate.

The catalyst is used preferably an amount of 1% to 100%, more preferably 3% to 40%, based on the total weight of the compounds (a) and (b).

In the formation of the intermediate coating layer, the copolymerization of the compounds (a) and (b) in the presence of the amine catalyst is usually carried out at a temperature of 30° C. to 80° C., preferably 50° C. to 60° C. for 2 hours to 120 hours.

The intermediate coating layer is preferably in an amount of 0.5% to 3.0%, more preferably 1.0% to 2.0%, based on the weight of the core filament.

The ratio in weight of the intermediate layer to the surface coating layer, is from 20:80 to 80:20, preferably from 40:60 to 60:40.

When the ratio is more than 80:20, the resultant surface-modified filament yarn exhibits a poor reeling property, an excessively high stiffness, and a reduced mechanical strength. Also, if the ratio in less than 20:80, the resultant surface-modified filament yarn or cord exhibits a poor fraying resistance and bonding property.

In the surface-modified filament of the present invention, the intermediate coating layer is coated with a surface coating layer comprising, as a principal component, a lubricant.

The lubricant usable for the present invention can be selected from conventional lubricant for filaments and preferably comprises at least one member selected from the group consisting of, for example, mineral oils; fatty acid esters, for example, isooctyl palmitate, oleyl oleate, ethylene glycol distearate, sorbitan trioleate, and dioleyl adipate; and polyethers, for example, copolymers of propylene oxide with ethylene oxide.

Preferably, the lubricant is non-compatible with the copolymerization product of the above-mentioned compounds (a) and (b) and exhibits a low polarity, so that the lubricant does not diffuse into the intermediate coating layer and is maintained in the surface coating layer. Also, the lubricant preferably bleeds to the outermost portion of the surface coating layer to form a lubricant membrane, when the compound (a) and (b) are copolymerized (cured).

The surface coating layer of the present invention is highly effective for enhancing the lubricity of the bundles of the resultant surface-modified filaments arranged in parallel to each other when the bundle is forwarded, for ensuring that the surface-modified filament yarns are not adhered to each other even when wound into a package and for easily taking up the surface-modified filament yarns from the package without difficulty.

Therefore, the lubricant preferably comprises a fatty acid ester having a relatively low molecular weight.

The surface coating layer may further contain, as an additional component, at least one member selected from antioxidants, anti-static agents, and emulsifiers, as long as the additional component does not affect the lubricity of the resultant surface coating layer. Usually, the additional component is in an amount of 50% by weight or less.

In the preparation of the surface-modified filaments of the present invention, the core filaments in the form of a yarn or cord are coated with a lubricant and then with a mixture of the components (a) and (b) with a catalyst.

In another method, the core filaments are coated with a mixture of the components (a) and (b) with a catalyst, and then with a lubricant.

In still another method which is simple and preferable, the core filaments are coated with a mixture of compounds (a) and (b), a catalyst, and a lubricant. The resultant coating layers on the core filaments are heated at a temperature of 30° C. to 80° C. so as to cause an intermediate coating layer to be formed on the core filaments and the lubricant to bleed to the outside surface of the intermediate coating layer and to form a surface coating layer.

The coating operations can be carried out, for example, by applying a coating solution or emulsion in the conventional manner, for example, the roller coating method, spraying method, or metering nozzle method.

The surface-modified wholly aromatic polyamide filaments have a satisfactory softness and rigidity or stiffness and are not adhered to each other, and thus can be easily taken up from a package and twisted to form a multifilament yarn or cord having a satisfactory quality and touch, without reducing the mechanical strength thereof.

When the surface-modified wholly aromatic polyamide multifilament yarn or cord is embedded, as a reinforcing material, in a matrix consisting of a rubber or synthetic resin material, the individual filaments located in a cut face portion of the resultant rubber or synthetic resin article are not frayed and separated from each other. Also, the yarn or cord can be firmly bonded to the matrix.

Therefore, the surface-modified wholly aromatic polyamide filaments are useful as a reinforcing material for rubber or synthetic resin articles.

EXAMPLES

The present invention will be further illustrated by way of specific examples, which, are merely representative do not restrict the scope of the present invention in any way.

In the examples, the following tests were carried out.

(1) Reeling property

Yarn is taken up from a yarn package through a taking up path formed between the package and a first guide and having a distance of 25 cm, at a speed of 20 m/min. The appearance of the taken-up yarn was observed by the naked eye, and the reeling property of the yarn was evaluated as follows:

| Class | Note |
|---|---|
| 5 | No fluff found |
| 4 | Length of fluffs of 1 cm or less |
| 3 | Length of fluffs of 1 to 5 cm |
| 2 | Length of fluffs of more than 5 cm |
| 1 | Yarn was broken |

(2) Rigidity (stiffness) of yarn

A bundle of yarn was touched by hand, and the touch was evaluated as soft or rigid.

(3) Tensile strength of twisted cord

A twisted cord was stretched by a tensile tester until breakage. The tensile strength of the cord was represented by the measured breaking stress/thickness in denier of the cord.

(4) Fraying property of cord

A raw edge type belt was prepared by embedding a cord in a rubber matrix and cut to form a cut face thereof. The cut face was observed by the naked eye, and the fraying property of the cord was evaluated as follows:

| Class | Note |
|---|---|
| 5 | No fraying |
| 4 | Very little fraying |
| 3 | Slight fraying |
| 2 | Much fraying |
| 1 | Remarkable fraying |

(5) Bonding property

The above-mentioned raw edge-type belt was vulcanized in a usual manner and subjected to a peeling test.

Examples 1 to 3 and Comparative Examples 1 and 2

In each of Examples 1 to 3 and Comparative Examples 1 and 2, a drawn wholly aromatic polyamide multifilament yarn having a yarn count of 1500 denier/1000 filaments was prepared from a polymerization product of 100 molar parts of terephthalic acid chloride with 50 molar parts of p-phenylene diamine and 50 molar parts of 3,4'-diaminodiphenylether by a usual spinning-drawing process.

An aqueous emulsion treating liquid containing copolymerization compounds (a) and (b), a catalyst and a lubricant in the composition as indicated in Table 1 was applied to the drawn multifilament yarn by using an oiling roller to coat the peripheral surfaces of the individual filaments with the treating liquid in an amount of 2% by dry weight based on the weight of the filaments. The coated multifilament yarn was dried by using a drying roller at a temperature of 120° C. and the dried multifilament yarn was wound up into a package.

The yarn package was allowed to stand in air at a temperature of 55° C. for 4 days to cure (copolymerize)

the copolymerization compounds (a) and (b) in the treating liquid.

During the drying and standing operations, the copolymerization product formed intermediate coating layers on the individual filaments and the lubricant formed surface coating layers on the intermediate coating layers.

Two surface-modified multifilament yarns were twisted at a twist number of 150 turns/m to provide a twisted cord.

The cord was immersion-coated with a resorcinol-formaldehyde resin latex (RFL liquid), and the resultant coated cord was heat-treated at a temperature of 200° C. for 2 minutes.

The coated cord was wound around a drum, and a chloroprene rubber sheet was laminated on the wound cord layer and vulcanized at a temperature of 150° C. for 30 minutes.

The cord-reinforced chloroprene rubber sheet was cut to provide test pieces each having a width of 2.5 cm and a length of 20 cm. The test pieces were subjected to the peeling strength test.

The results of the afore-mentioned tests are shown in Table 1.

TABLE 1

| Item | Example No. Example 1 | 2 | 3 | Comparative Example 1 | 2 |
|---|---|---|---|---|---|
| Composition of treating liquid | | | | | |
| Bisphenol A-type, urethane-modified epoxy compound (a) *1 (wt part) | 25 | 3 | 40 | — | 50 |
| Aliphatic polyglycidylether compound (b) *2 (wt part) | 25 | 47 | 10 | 50 | — |
| Piperadine hexahydrate *3 (wt part) | 7 | 7 | 7 | 7 | 7 |
| Lubricant *4 (wt part) | 50 | 50 | 50 | 50 | 50 |
| Resultant surface-modified filament yarn | | | | | |
| Reeling property | 4 | 4 | 5 | 2 | 5 |
| Touch | Soft | Soft | Soft | Stiff | Soft |
| Twisted cord | | | | | |
| Tensile strength (g/d) | 20 | 21 | 22 | 18 | 23 |
| Fraying resistance | 5 | 5 | 4 | 5 | 3 |
| Peeling strength (kg) | 45 | 48 | 40 | 50 | 35 |

Note:
*1 Trademark: Denacast EM102, made by Nagase Kasei Co., Epoxy equivalent = 380, water soluble
*2 Trademark: Deconal EX512, made by Nagase Kasei Co., Epoxy equivalent = 166
*3 Catalyst
*4 Mixture of dioleyl adipate (60 parts by weight), sodium dioctylsulfosuccinate (10 parts by weight), and polyoxyethylene (POE) added, hardened castor oil (30 parts by weight).

Examples 4 to 6 and Comparative Examples 3 and 4

In each of Examples 4 to 6 and Comparative Examples 3 and 4, the same procedures as in Example 1 were carried out except that the proportions of the resinous mixture of the bisphenol A-type, urethane-modified epoxy compound (a), the aliphatic polyglycidylether compound (b), the catalyst, and the lubricant were as indicated in Table 2.

The test results are shown in Table 2.

TABLE 2

| Item | Example No. Example 4 | 5 | 6 | Comparative Example 3 | 4 |
|---|---|---|---|---|---|
| Composition of treating liquid | | | | | |
| Resinous mixture (wt part) *5 | 20 | 60 | 80 | 10 | 90 |
| Lubricant | 80 | 40 | 20 | 90 | 10 |
| Resultant surface-modified filament yarn | | | | | |
| Reeling property | 4 | 4 | 4 | 5 | 2 |
| Touch | soft | soft | soft | soft | stiff |
| Twisted cord | | | | | |
| Tensile strength (g/d) | 23 | 21 | 20 | 24 | 17 |
| Fraying resistance | 3 | 4 | 4 | 2 | 5 |
| Peeling strength (kg) | 40 | 45 | 47 | 35 | 49 |

Note:
*5 Mixture of compound (a) (25 parts by weight), compound (b) (25 parts by weight) and catalyst (7 parts by weight) of Example 1 as indicated in Table 1

As clearly shown in Tables 1 and 2, the surface-modified wholly aromatic polyamide filament yarns or cords have a satisfactory softness, reeling property, mechanical strength, fraying resistance, and bonding (peeling) strength.

I claim:

1. Surface-modified wholly aromatic polyamide filaments each comprising a core filament consisting essentially of a wholly aromatic polyamide;

an intermediate coating layer formed on the peripheral surface of the core filament and consisting essentially of a copolymer of (a) at least one bisphenol A urethane-modified epoxy compound having an epoxy equivalent of 200 to 800 and being water-soluble of self-emulsifiable in water with (b) at least one type of aliphatic polyglycidylether compound having an epoxy equivalent of 100 to 250 and provided with two or more glycidylether groups per molecule thereof; and a surface coating layer formed on the intermediate coating layer and comprising, as a principal component, a lubricant, a ratio in weight of the intermediate coating layer to the surface coating layer being from 20:80 to 80:20.

2. The filaments as claimed in claim 1, wherein the wholly aromatic polyamide is a polymerization product of an aromatic dicarboxylic acid component comprising at least one member selected from the group consisting of terephthalic acid, isophthalic acid, 1,4-naphthalene dicarboxylic acid, 4,4'-biphenyldicarboxylic acid, and anhydrides, acid chlorides, esters, and salts of the above-mentioned acids, with an aromatic diamine component comprising at least one member selected from the group consisting of p-phenylene diamine, m-phenylene diamine, 3,4'-diaminodiphenylether, and 4,4'-diaminodiphenyl ether.

3. The filaments as claimed in claim 1, wherein each core filament has a denier of 0.5 to 10.

4. The filaments as claimed in claim 1, wherein the bisphenol A urethane-modified epoxy compound (a) is selected from modified bisphenol A epoxy compounds having at least one modifying group selected from the group consisting of polyether and polyester radicals per molecule thereof, and attached thereto through a urethane bond.

5. The filaments as claimed in claim 1, wherein the aliphatic polyglycidylether compound (b) is selected from polyglycidyl ethers of glycol compounds including polyethylene glycols, polypropylene glycols, neopentylglycol, glycerol, polyglycerol, trimethylolpropane, and sorbitol.

6. The filaments as claimed in claim 1, wherein in the intermediate coating layer, the ratio in weight of the bisphenol A urethane-modified epoxy compound (a) to the aliphatic polyglycidylether compound (b) is in the range of from 95:5 to 20:80.

7. The filaments as claimed in claim 1, wherein the intermediate coating layer is in an amount of 0.5% to 3.0% based on the weight of the core filament.

8. The filaments as claimed in claim 1, wherein the lubricant in the surface coating layer comprises at least member selected from the group consisting of mineral oils, isooctyl palmitate, oleyl oleate, ethylene glycol distearate, sorbitan trioleate, dioleyl adipate, and copolymers of propylene oxide with ethylene oxide.

9. The filaments as claimed in claim 1, wherein the surface coating layer is in an amount of 0.5% to 3.0%-based on the weight of the core filament.

10. The filaments as claimed in claim 1, which are in the form of a multifilament yarn or cord.

* * * * *